US006499363B1

(12) United States Patent
Morimoto et al.

(10) Patent No.: US 6,499,363 B1
(45) Date of Patent: Dec. 31, 2002

(54) TIP FOR PIPETTE AND PIPETTE WITH THE SAME

(75) Inventors: Ichiro Morimoto, Osaka (JP); Kiyoto Shigematsu, Tokyo (JP); Isao Shimada, Tokyo (JP); Eiji Hishinuma, Tokyo (JP); Isao Inagaki, Gifu (JP)

(73) Assignee: The Sailor Pen Co., Ltd., Tokyo (JP)

( * ) Notice: Subject to any disclaimer, the term of this patent is extended or adjusted under 35 U.S.C. 154(b) by 0 days.

(21) Appl. No.: 09/468,858

(22) Filed: Dec. 21, 1999

Related U.S. Application Data

(63) Continuation-in-part of application No. 08/989,775, filed on Dec. 12, 1997, now Pat. No. 6,021,680.

(51) Int. Cl.[7] ..... B01L 3/02

(52) U.S. Cl. ..... 73/864.01; 73/864.14; 73/864.16; 73/864.17

(58) Field of Search ..... 73/864.01, 864.14, 73/864.13, 864.16, 864.17, 864.18

(56) References Cited

U.S. PATENT DOCUMENTS

| | | | | | |
|---|---|---|---|---|---|
| 4,036,064 | A | | 7/1977 | Hydo | |
| 4,105,522 | A | * | 8/1978 | Friedenberg et al. | 204/406 |
| 4,237,095 | A | * | 12/1980 | Suovaniemi et al. | 73/864.18 X |
| 4,284,213 | A | * | 8/1981 | Lee | 222/541 |
| 4,768,954 | A | * | 9/1988 | Dragan | 433/90 |
| 4,961,350 | A | * | 10/1990 | Tennstedt | 73/864.01 |
| 5,024,654 | A | * | 6/1991 | Tyler | 604/43 |
| 5,027,872 | A | * | 7/1991 | Taylor et al. | 141/347 |
| 5,413,006 | A | | 5/1995 | D'Autry | 73/864.18 |
| 5,435,197 | A | | 7/1995 | Telimaa et al. | 77/864.14 |
| 5,580,529 | A | * | 12/1996 | DeVaughn et al. | 73/864.14 X |
| 6,030,582 | A | * | 2/2000 | Levy | 422/100 X |
| 6,116,099 | A | * | 9/2000 | Carl | 73/864.14 |
| 6,315,549 | B1 | * | 11/2001 | Jenko et al. | 425/549 |

FOREIGN PATENT DOCUMENTS

| | | | | |
|---|---|---|---|---|
| FR | 2772006 | * | 6/1999 | B65D/47/06 |
| GB | 2029723 A | * | 3/1980 | 73/864.13 |
| JP | 62-34587 | | 9/1987 | B01L/3/02 |
| JP | 6-23283 | | 1/1994 | B01L/3/02 |
| JP | 6-210188 | | 8/1994 | B01L/3/02 |
| JP | 7-284674 | * | 10/1995 | B01L/3/02 |
| JP | 8-313403 | | 11/1996 | B01L/3/02 |

* cited by examiner

*Primary Examiner*—Thomas P. Noland
(74) *Attorney, Agent, or Firm*—Nixon Peabody LLP; Donald R. Studebaker

(57) ABSTRACT

A nozzle 33 is formed on a distal end side of a cylinder 3. The nozzle 33 has an intermediate portion 3*b* formed such that a tip 7 is freely attachable thereto and detachable therefrom. The intermediate portion 3*b* of the nozzle 33 is formed with an annular projection 3*e* for retaining the tip 7. The tip 7 has a thick portion 7*a* provided in a root portion thereof and formed larger in diameter than a root portion 3*a* of the nozzle 33 to be abuttable against a tip releasing member 11. Along an inner periphery of the root portion of the tip 7, an annular projection 7*b* is formed to contact with the annular projection 3*e* of the nozzle 33 thereby providing a seal with the nozzle 33. Both the annular projections 3*e* and 7*b* of the nozzle 33 and the tip 7 are arranged to reach a position where a sound of abutment is produced between the root end surface of the tip 7 and the shoulder of the nozzle 33 at the completion of fitting of the tip 7 onto the nozzle 33.

9 Claims, 17 Drawing Sheets

TIP FOR PIPETTE AND PIPETTE WITH THE SAME

This application is a Continuation-in-Part of application Ser. No. 08/989,775, filed Dec. 12, 1997, and now U.S. Pat. No. 6,021,680.

FIELD OF THE INVENTION

This invention relates to a tip for a pipette used for transferring a specified amount of liquid from one vessel into another vessel and a pipette with the tip.

BACKGROUND OF THE INVENTION

A pipette is generally used, for example, when a sample of liquid for an analysis is transferred from a vessel for sample picking into a vessel for an analysis. As a pipette of such kind, there is known one which has a small-diameter nozzle formed at a tip end of a body vessel and a suction chamber formed in a middle part of the body vessel.

The nozzle of the pipette is put in a liquid in the vessel for sample picking with the suction chamber compressed, and the suction chamber is then reduced in pressure so that the pipette sucks a liquid sample. Thereafter, the nozzle is inserted into the vessel for an analysis, and the suction chamber is then compressed again so that the pipette discharges the sucked liquid sample into the vessel for an analysis. In this manner, the liquid sample is transferred from the vessel for sample picking to the vessel for an analysis.

The above-mentioned convention pipette is a fixed-capacity type one in which the amount of a single suction of liquid sample is fixed. Therefore, its range of use is limited, which invites poor versatility. For example, when urinalysis is carried out in a physical checkup or the like, picked urine is first centrifuged, the supernatant fluid is then removed and 200 $\mu$l of liquid sample is prepared. Thereafter, 200 $\mu$l of liquid sample and the residue are mixed and from the mixture thus obtained, 15 $\mu$l of liquid sample for a urine precipitation test is picked up.

Thus, since the amount of suction of the conventional pipette is fixed, 200 $\mu$l sampling and 15 $\mu$l sampling cannot readily be set, resulting in expending much time and effort in carrying out urinalysis.

To cope with this, there is proposed a variable-capacity type pipette which is variable in sampling amount, as disclosed in Japanese Patent Application Laid-Open Gazette No. 8-332397. In this pipette, however, since a tip is simply fitted to a nozzle, this makes it difficult to determine whether or not the attachment of the tip to the nozzle has been fully completed.

In particular, the tip as mentioned above requires detachment and replacement with a new one for each sampling. In addition, there is a strong demand for prompt analyses of a large number of samples. Therefore, the tip should be attached to the nozzle with ease and reliability and simultaneously should be detached therefrom with ease. Additionally, since it is necessary that the pipette ensures providing a constant sampling amount at any time, a reliable seal must be formed between the tip and the nozzle. As a result, two opposing requirements, i.e., ensured sealing property and ease of detachment, must be satisfied.

The present invention has been made in view of the foregoing problems and therefore has its object of making a tip readily detachable from a pipette and providing ensured sealing property between the tip and a nozzle of the pipette.

SUMMARY OF THE INVENTION

To attain the above object, a first solution of the present invention is directed to a tip freely attachable to and detachable from a nozzle of a pipette. And, the tip includes: a tapered tip body having an elongated cylindrical form; a nozzle-fitting part formed in a root portion of the tip body; an annular part formed along an inner periphery of the nozzle-fitting part to extend inwardly therefrom for close contact with an outer periphery of the nozzle; and a thick portion formed around an outer periphery of an end portion of the nozzle-fitting part to extend outwardly therefrom for abutment against a tip releasing member for detaching the tip body from the nozzle of the pipette.

In a second solution of the present invention, the nozzle of the pipette in the first solution includes a root portion, a tip attachment part formed smaller in diameter than the root portion and continuously therefrom through a shoulder, and an annular part formed around an outer periphery of the tip attachment part to extend outwardly therefrom. Further, the annular part of the tip body is formed to be closely contactable with the annular part of the nozzle and to reach a position where a feeling of fitting between the tip body and the nozzle is provided through the abutment of an end surface of the nozzle-fitting part of the tip body against the shoulder of the nozzle at the completion of fitting of the tip body onto the nozzle. In addition, the thick portion of the nozzle-fitting part of the tip body is formed larger in diameter than the root portion of the nozzle to be located outside the root portion of the nozzle for abutment against the tip releasing member freely movable in an axial direction of the nozzle.

In a third solution of the present invention, both the annular parts of the nozzle and the tip body in the second solution are each formed into a projection of half-round cross section, and the annular part of the tip body is formed to complete the fitting of the tip body onto the nozzle by snapping over the annular part of the nozzle.

A fourth solution of the present invention is directed to a pipette. The pipette includes: a cylindrical casing; a cylinder provided in the casing; a suction chamber formed in the cylinder; a nozzle which is continuously formed at an outward end of the cylinder to extend to the outside of the casing and has a suction passage in communication with the suction chamber; at least one piston which is provided in the casing and is reciprocatably inserted into the suction chamber to suck and discharge liquid; and a tip freely attachable to and detachable from the nozzle.

The nozzle includes a root portion, a tip attachment part formed smaller in diameter than the root portion and continuously from the root portion through a shoulder, an annular part formed around an outer periphery of the tip attachment part to extend outwardly therefrom, and a tip releasing member provided outside of the root portion and freely movable in an axial direction of the nozzle.

The tip includes a tapered tip body having an elongated cylindrical form, a nozzle-fitting part formed in a root portion of the tip body, an annular part which is formed along an inner periphery of the nozzle-fitting part to extend inwardly therefrom and closely contacts with the annular part of the nozzle, and a thick portion formed around an outer periphery of an end portion of the nozzle-fitting part to extend outwardly therefrom and having a larger diameter than that of the root portion of the nozzle to be abuttable against the tip releasing member.

A fifth solution of the present invention is directed to a pipette. The pipette includes a cylindrical casing; a cylinder formed at an inner tip end of the casing; a first suction chamber which is formed in the cylinder and is open on an inward end surface of the cylinder; a nozzle which is formed at an outward end of the cylinder to extend to the outside of the casing and has a suction passage in communication with the first suction chamber; and a first piston reciprocatably inserted into the first suction chamber.

Further, the pipette includes: a second suction chamber which is formed in the first piston and is open on both end surfaces of the first piston; a second piston reciprocatably inserted into the second suction chamber, the second piston including a small-diameter part insertable into the second suction chamber and a large-diameter part engageable with the first piston to push the first piston; a first resilient member which pushes the first piston in a direction of protruding from the cylinder; and a second resilient member which pushes the second piston in a direction of protruding from the first piston, the second resilient member having less resiliency than the first resilient member.

In addition, the pipette includes: an operating lever which is provided in the casing, comes into contact at an inward end thereof with a top surface of the second piston, and operates the first and second pistons to switch between a small suction position where the second piston is extremely retracted in the first piston and a large suction position where the first and second pistons are extremely retracted in the cylinder and the first piston, respectively; and a tip freely attachable to and detachable from the nozzle.

The nozzle includes a root portion, a tip attachment part formed smaller in diameter than the root portion and continuously from the root portion through a shoulder, an annular part formed around an outer periphery of the tip attachment part to extend outwardly therefrom, and a tip releasing member provided outside of the root portion and freely movable in an axial direction of the nozzle.

The tip includes a tapered tip body having an elongated cylindrical form, a nozzle-fitting part formed in a root portion of the tip body, an annular part which is formed along an inner periphery of the nozzle-fitting part to extend inwardly therefrom and closely contacts with the annular part of the nozzle, and a thick portion formed around an outer periphery of an end portion of the nozzle-fitting part to extend outwardly therefrom and having a larger diameter than that of the root portion of the nozzle to be abuttable against the tip releasing member.

A sixth solution of the present invention is directed to a pipette. The pipette includes: a cylindrical casing; a cylinder formed at an inner tip end of the cylindrical casing; a first suction chamber which is formed in the cylinder and is open on an inward end surface of the cylinder; a nozzle which is formed at an outward end of the cylinder to extend to the outside of the casing and has a suction passage in communication with the first suction chamber; a first piston which is reciprocatably inserted into the first suction chamber; a second suction chamber which is formed in the first piston and is open on both end surfaces of the first piston; and a second piston which is reciprocatably inserted into the second suction chamber.

The pipette further includes: a first resilient member which pushes the first piston in a direction of protruding from the cylinder, the first resilient member surrounding the second suction chamber; and a second resilient member which pushes the second piston in a direction of protruding from the first piston, the second resilient member having less resiliency than the first resilient member.

Further, the pipette includes: an operating lever which is provided in the casing, comes into contact at an inward end surface thereof with a top surface of the second piston, and operates the first and second pistons to switch between a small suction position where the second piston is extremely retracted in the first piston and a large suction position where the first and second pistons are extremely retracted in the cylinder and the first piston, respectively; and a tip freely attachable to and detachable from the nozzle.

The nozzle includes a root portion, a tip attachment part formed smaller in diameter than the root portion and continuously from the root portion through a shoulder, an annular part formed around an outer periphery of the tip attachment part to extend outwardly therefrom, and a tip releasing member provided outside of the root portion and freely removable in an axial direction of the nozzle.

The tip includes a tapered tip body having an elongated cylindrical form, a nozzle-fitting part formed in a root portion of the tip body, an annular part which is formed along an inner periphery of the nozzle-fitting part to extend inwardly therefrom and closely contacts with the annular part of the nozzle, and a thick portion formed around an outer periphery of an end portion of the nozzle-fitting part to extend outwardly therefrom and having a larger diameter than that of the root portion of the nozzle to be abuttable against the tip releasing member.

In a seventh solution of the present invention, both the annular parts of the tip and the nozzle in any one of the fourth through sixth solutions are provided to reach a position where a feeling of fitting between the tip and the nozzle is provided between a root end surface of the nozzle-fitting part of the tip and the shoulder of the nozzle at the completion of fitting of the tip onto the nozzle.

In an eighth solution of the present invention, both the annular parts of the nozzle and the tip in any one of the fourth through sixth solutions are each formed into a projection of half-round cross section, and the annular part of the tip is formed to complete the fitting of the tip onto the nozzle by snapping over the annular part of the nozzle.

A ninth solution of the present invention is constructed such that in any one of the fourth through sixth solutions, a resilient member for pushing the tip releasing member in a direction away from a distal end of the nozzle is interposed between a tip end of the casing and the tip releasing member, and detaching means is provided for moving the tip releasing member to release the tip from the nozzle.

In the above-mentioned solutions of the invention, first, the tip is connected to the cylinder by fitting the tip onto the nozzle. In this case, when the nozzle is inserted into the tip, the annular part of the tip slides over the annular part of the nozzle. At the completion of insertion of the nozzle into the tip, a feeling of fitting such as an abutment sound is provided between the end surface of the tip and the shoulder of the nozzle. The analyzer recognizes the completion of insertion based on this feeling of fitting.

When the fitting between the tip and the nozzle is completed, both the annular parts of the tip and the nozzle are closely contacted with each other so that a seal is formed between the tip and the nozzle. Then, the piston is reciprocated to suck liquid.

More specifically, in the fifth and sixth solutions, the first piston extends from the cylinder and the second piston extends from the first piston. In a state that the first and second pistons are in their extreme extended positions, the operating lever is pushed. At the time, the casing is gripped with one hand of the analyzer and a push part of the operating lever is pushed with a thumb of the hand.

Through the push of the operating lever, the second piston is initially pushed down. At this time, since the resiliency of the first resilient member is smaller than that of the second resilient member, the second piston is first inserted into the second suction chamber. As a result, the capacity of the second suction chamber is reduced. When the operating lever is further pushed down, the second piston is inserted to a deepest position into the second suction chamber so that the second piston is set in the small suction position for sampling a small amount of liquid.

When the operating lever is still further pushed down, the second piston pushes the first piston downward so that the first piston moves in the first suction chamber. As a result, the capacity of the first suction chamber is reduced. Then, when the operating lever is pushed down to the deepest position, the first piston is inserted to a deepest position into the first suction chamber so that the first piston is set in the large suction position for sampling a large amount of liquid.

In this manner, at the push of the operating lever, sampling a small amount of liquid and sampling a large amount of liquid are selectively executed.

For detachment of the tip from the nozzle, the tip releasing member is moved downward by the detaching means in the ninth solution. When being moved, the tip releasing member abuts against the thick portion of the tip thereby releasing the tip.

According to the present invention, since the annular part provided along the inner periphery of the tip forms a seal between the tip and the nozzle, the attachment of the tip can be made with reliability. As a result, a large number of samples can be analyzed promptly and reliably.

In particular, since the annular parts, provided in the tip and the nozzle, respectively, form a seal therebetween and a feeling of fitting therebetween is provided at the position where the insertion of the nozzle into the tip is completed, the attachment of the tip can be correctly recognized.

Further, though the tip is required to be detached for each sampling and replaced with a new one, the pipette of the present invention enables prompt analyses of a large number of samples in such a case.

Furthermore, since the annular part of the tip comes into close contact with the annular part of the nozzle by snapping over the annular part of the nozzle, a seal can reliably be provided between the tip and the nozzle. Accordingly, sucking liquid can be made correctly, which provides an improved analyzing accuracy.

Moreover, the release of the tip is implemented by simply snapping out the annular part of the tip over the annular part of the nozzle, and therefore a contact area between the tip and the nozzle is small. Accordingly, the release of the tip can be made readily. As a result, the tip can be released with one hand, which provides improved workability.

If the detaching means is provided, the tip can be detached by simply operating the detaching means. As a result, samples are prevented from making contact with a hand, which enables the analysis or the like to be executed in a prompt and considerably sanitary manner.

Further, since the first and second pistons are both inserted to a deepest position into the cylinder and are reciprocated, selection can be made between a large amount sampling and a small amount sampling. As a result, the pipette of the present invention provides an extended range of applications as compared with the conventional pipette whose sampling amount is limited to a fixed amount. In particular, when a large number of samples are analyzed, a necessary amount of liquid can readily be sampled, which achieves prompt analyzing.

Furthermore, since the pipette of the present invention can simplify the structure and reduce the number of parts as compared with the conventional pipette of the capacity-variable type whose sampling amount is arbitrarily set, this reduces the manufacturing cost.

Moreover, selection between the large amount sampling and the small amount sampling can be made with one hand, i.e., at the push of the push part with a thumb. As a result, operation can be simplified thereby speeding up the execution of various kinds of analyses.

BRIEF DESCRIPTION OF THE DRAWINGS

FIG. 8 is an exploded perspective view showing a cylinder, a first piston, a second piston and so on.

DESCRIPTION OF THE EMBODIMENT

Figure 1:
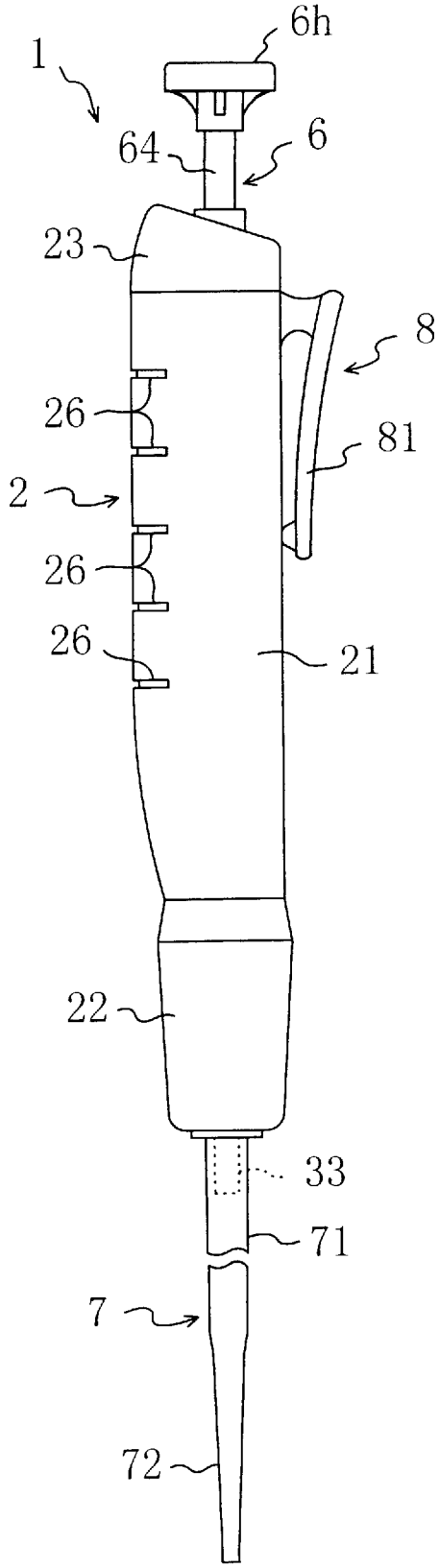
FIG. 1 is a side view of a pipette of the present invention to which a tip is attached.
Figure 2:
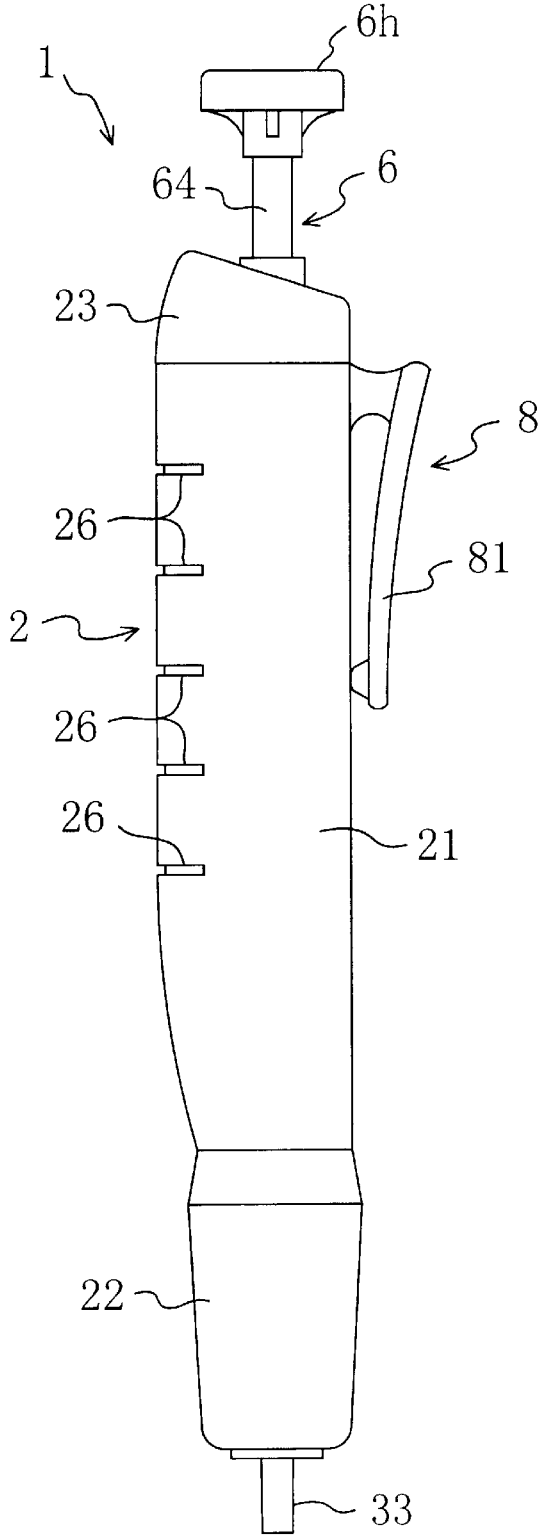
FIG. 2 is a side view of the pipette from which the tip is detached.
Figure 3:
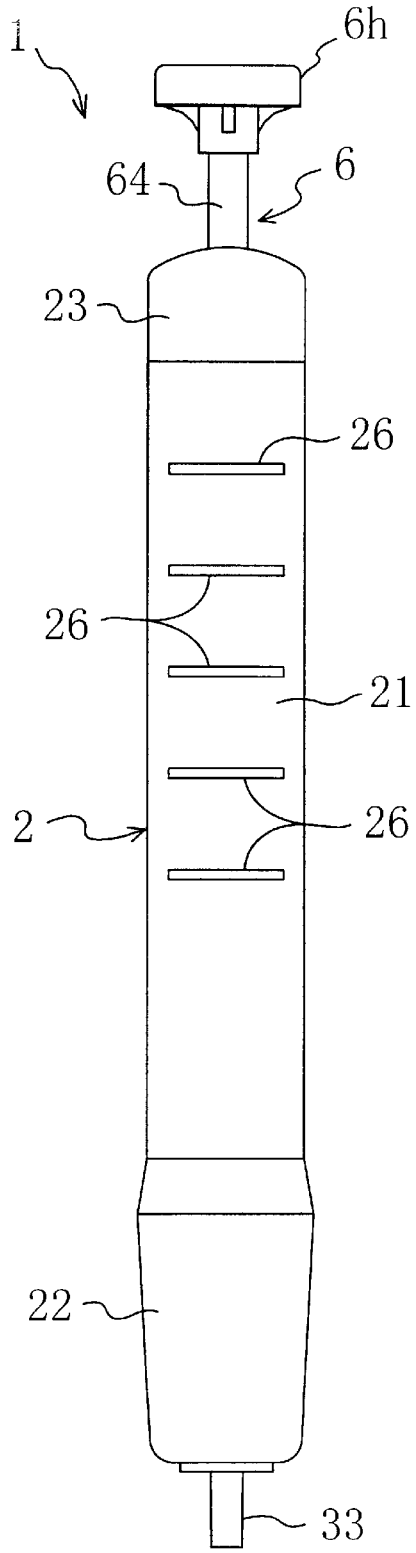
FIG. 3 is a front view of the pipette from which the tip is detached.
Figure 4:
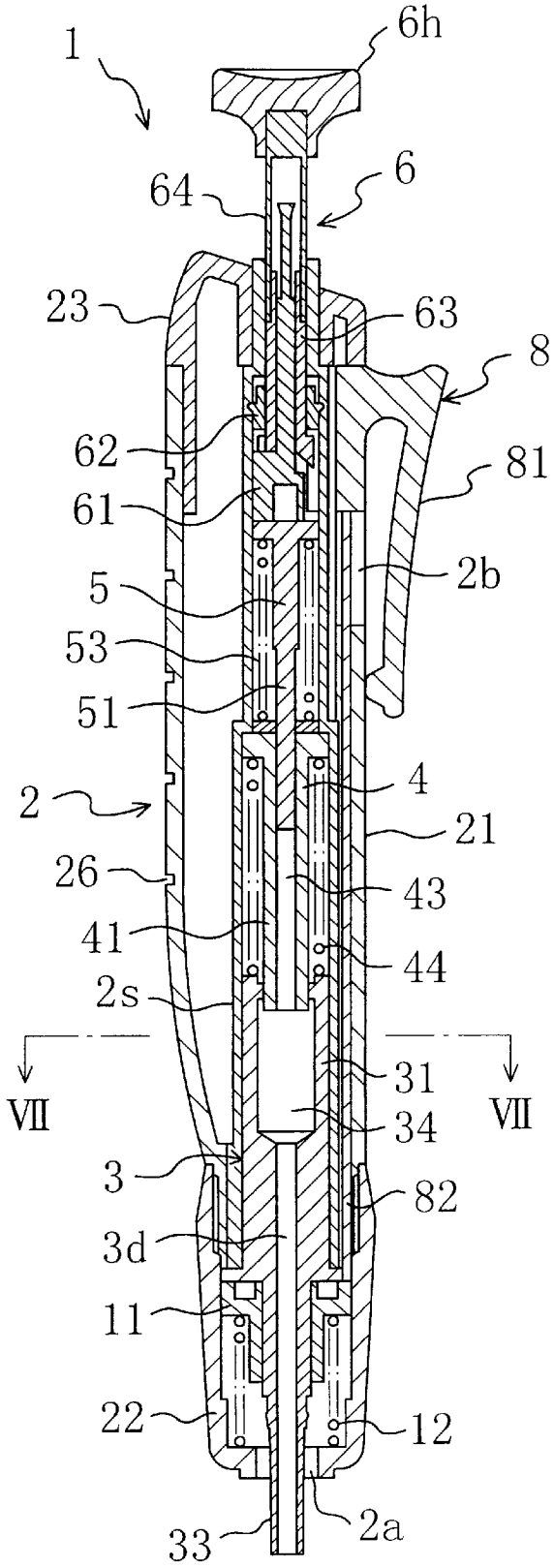
FIG. 4 is a vertical cross section of the pipette from which the tip is detached.

Description will be made below about an embodiment of the present invention with reference to the drawings.

General Construction

As shown in FIGS. 1 to 3 and FIGS. 4 to 10, a pipette 1 is for transferring various kinds of liquid samples from one vessel to another vessel. The pipette 1 is so constructed that selection can be made between sampling a large amount of liquid and sampling a small amount of liquid. In a casing 2 of the pipette 1, a cylinder 3, a first piston 4, a second piston 5, an operating lever 6 and so on are housed.

The casing 2 has a body part 21, an end cap 22 fitted on a tip end portion of the body part 21, and a head cap 23 fitted in a top end portion of the body part 21. The body part 21 is internally formed with a hollow core 2*s* whose both end surfaces are open. In the core 2*s,* a large-diameter hole 24 on the tip end side and a small-diameter hole 25 on the top side are continuously formed via a shoulder.

The outline of the body part 21 is approximately elliptical in cross section. The body part 21 has a plurality of anti-slipping lateral grooves 26 formed in the side surface thereof on the opposite side of a clip 81. Namely, the lateral grooves 26 are formed to prevent slippage of the body part 21 so that the body part 21 can be gripped readily and reliability with a palm and fingers.

Figure 8:
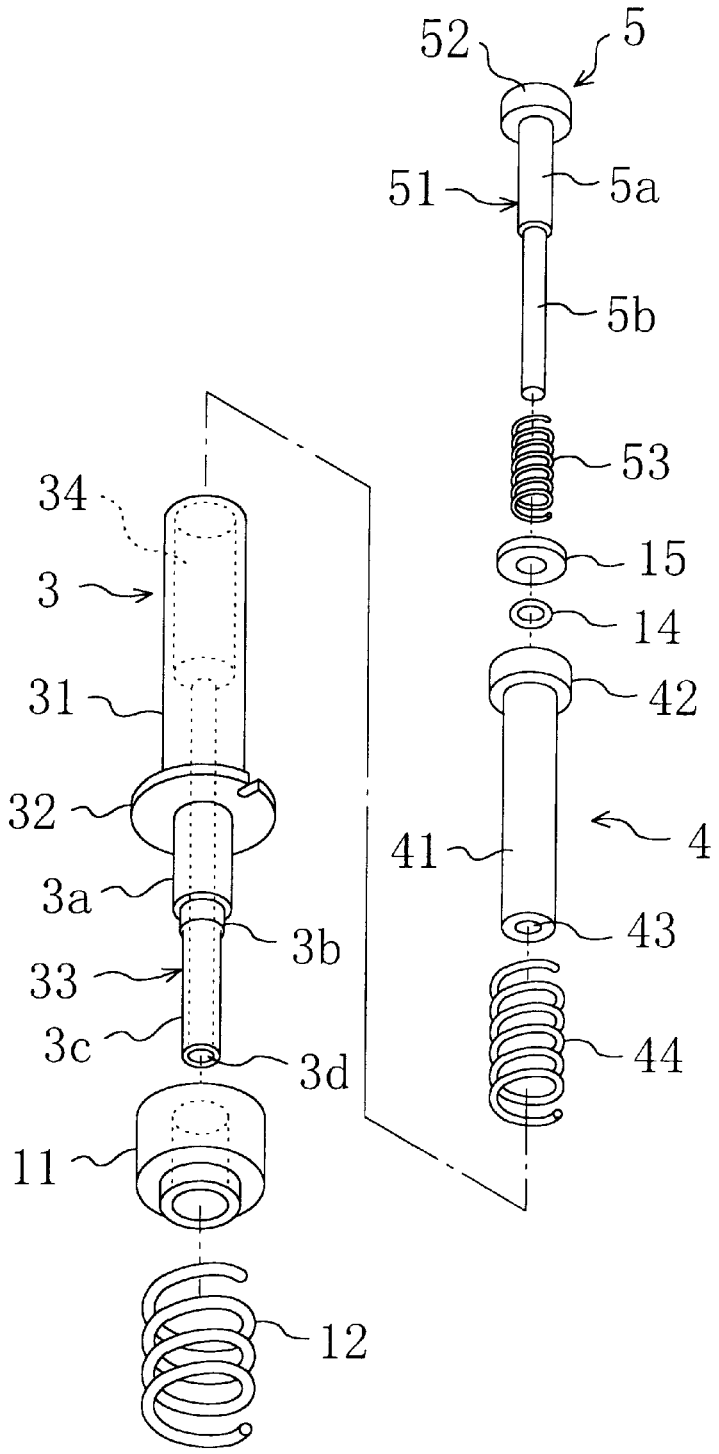

Also as shown in an exploded perspective view of FIG. 8, the cylinder 3 includes a cylinder body 31 and a nozzle 33. A flange 32 is formed at a lower end of a cylinder body 31. The nozzle 33 and the cylinder body 31 are formed in one piece. The cylinder body 31 is inserted into the large-diameter hole 24 of the body part 21 of the casing 2. The flange 32 is formed so as to have a diameter as large as the tip end surface of the body part 21 and come into contact with it. Further, the cylinder body 31 is internally formed with a first suction chamber 34 open on an inward end surface thereof located at the upper end in FIG. 5.

The first piston 4 includes a cylindrical piston body 41 and a flange 42 integrally formed at lone end of the piston body 41. An inner space of the first piston 4 is formed into a second suction chamber 43 whose both end surfaces are open. The piston body 41 is reciprocatably inserted into the first suction chamber 34 and comes into air-tight contact with the cylinder 3 through a sealing ring 13.

The flange 42 of the first piston 4 is formed in a diameter to allow contact with the large-diameter hole 24 of the casing 2. Between the flange 42 and the cylinder body 31, a first spring 44 as a first resilient member is interposed. The first spring 44 pushes the first piston 4 in a direction to extend it. Thereby, the flange 42 is brought into contact with the shoulder formed between the large-diameter hole 24 and the small-diameter hole 25 of the body part 21. In this manner, the first piston 4 is kept in its extreme extended position.

The second piston 5 includes a bar-shaped piston body 51 and a flange 52 integrally formed at one end of the piston body 51. The piston body 51 consists of a large-diameter part 5*a* and a small-diameter part 5*b*. The small-diameter part 5*b* of the piston body 51 is reciprocatably inserted into the second suction chamber 43, and comes into air-tight contact with the first piston 4 through a sealing ring 14. The large-diameter part 5*a* of the piston body 51 is formed so as to be abuttable against the flange 42 of the first piston 4.

The flange 52 of the second piston 5 is formed in a diameter to allow contact with the small-diameter hole 25 of the casing 2. Between the flange 52 of the second piston 5 and the flange 42 of the first piston 4, a second spring 53 as a second resilient member is interposed. The second spring 53 pushes the second piston 5 in a direction to extend it. In addition, the second spring 53 is set to have less resiliency than the first spring 44. Thereby, the second piston 5 is kept in its extreme extended position with the operating lever 6 in contact with the flange 52.

Between the second spring 53 and the flange 42 of the first piston 4, a retaining member 15 for retaining the sealing ring 14 is interposed.

Figure 9:
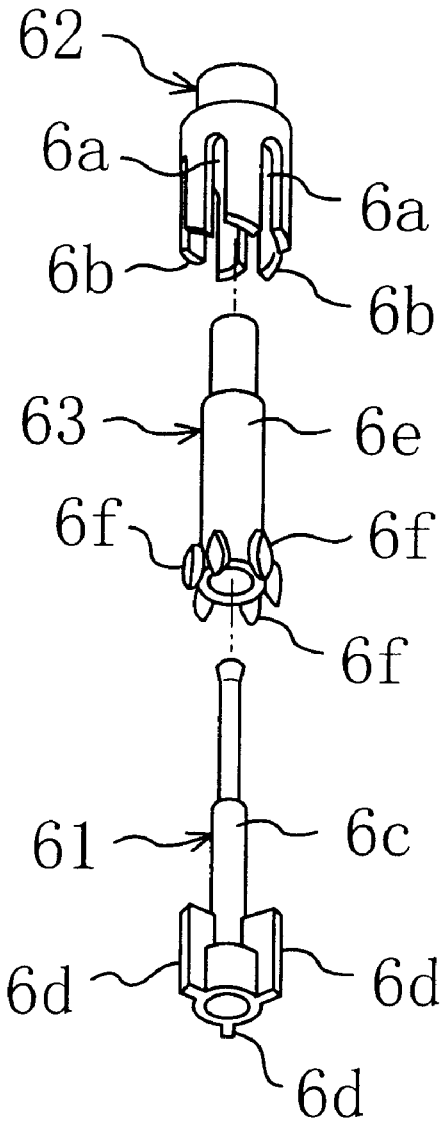
FIG. 9 is an exploded perspective view showing an operating lever.

As shown in FIG. 9, the operating lever 6 includes a knocking mechanism, and the knocking mechanism includes a rotor 61, a guide member 62, a knocking member 63 and a knocking cover 64. The operating lever 6 is provided movably along the axis of the casing 2, and is constructed to operate the first and second pistons 4 and 5 to switch between a small suction position and a large suction position. The small suction position is a position where the second piston 5 is extremely retracted in the first piston 4, while the large suction position is a position where the first and second pistons 4 and 5 are extremely retracted in the cylinder 3 and the first piston 4, respectively.

The guide member 62 is formed in an approximately cylindrical shape, and is fixedly fitted in a top part of the small-diameter hole 25 of the body, part 21 of the casing 2. The guide member 62 has a plurality of slide grooves 6*a,* 6*a,* . . . The plurality of, for example, six slide grooves 6*a,* 6*a,* . . . are each opened at one end thereof (lower end of FIG. 9). Strips 6*b,* 6*b,* ... between the adjacent slide grooves 6*a,* 6*a,* . . . are each formed such that a bottom surface thereof is inclined from one to another of two adjacent slide grooves 6*a,* 6*a.*

The rotor 61 includes a small-diameter shaft part 6*c* and a plurality of slide parts 6*d,* 6*d,* . . . The plurality of slide parts 6*d,* 6*d,* . . . are formed to extend axially from one end (lower end in FIG. 9) of the shaft part 6*c,* and are formed continuously with the shaft part 6*c.* The rotor 61 is disposed such that the bottom surface thereof comes into contact with the flange 52 of the second piston 5 and the shaft part 6*c* coaxially passes through the guide member 62. The slide parts 6*d,* 6*d,* . . . are provided by the half number of slide grooves 6*a,* 6*a,* . . . , for example, by three. Further, the slide parts 6*d,* 6*d,* . . . have inclined top surfaces corresponding to the inclined bottom surfaces of the strips 6*b,* 6*b,* . . . , respectively, so as to be capable of freely entering and exiting from the slide grooves 6*a,* 6*a,* . . .

The knocking member 63 includes a cylindrical shaft part 6*e* and a plurality of cams 6*f,* 6*f,* .... The plurality of cams 6*f,* 6*f,* ... are each formed in an approximately elliptical shape, and are formed continuously from one end (lower end in FIG. 9) of the shaft part 6*e.* The shaft part 6*e* of the knocking member 63 coaxially passes through the guide member 62, and the shaft part 6*c* of the rotor 61 is inserted into the shaft part 6*e.* The cams 6*f,* 6*f,* . . . are provided by the number corresponding to the number of slide grooves 6*a,* 6*a,* . . . , for example, by six, and are positioned in the slide grooves 6*a,* 6*a,* . . . , respectively. Half of the cams 6*f,* 6*f* . . . come into contact with the slide parts 6*d,* 6*d,* . . . , respectively.

The knocking cover 64 includes a shaft part 6*g* and a push part 6*h.* The push part 6h is formedin a disk-like shape, and is integrally formed at one end (upper end in FIG. 6) of the shaft part 6*g.* The lower end of the shaft part 6*g* passes through the head cap 23 of the casing 2 and is fitted on the shaft part 6*e* of the knocking member 63, so that the knocking cover 64 is disposed coaxially with the knocking member 63. When the knocking cover 64 is pushed, the cams 6*f,* 6*f,* . . . push the slide parts 6*d,* 6*d,* . . . downward. Then, when the slide parts 6*d,* 6*d,* exit from the slide grooves 6*a,* 6*a,* . . . , the rotor 61 rotates and the second piston 5 is set in the small suction position.

Figure 5:
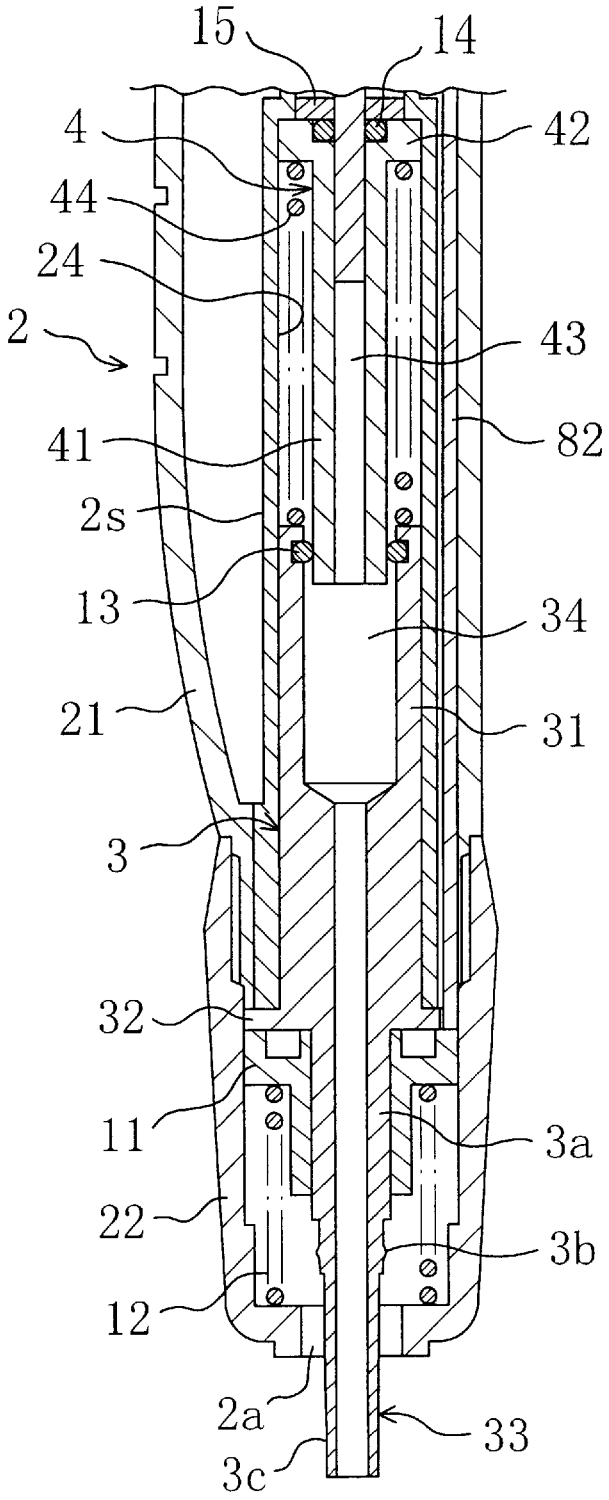
FIG. 5 is an enlarged vertical cross section showing the tip side portion of the pipette.
Figure 6:
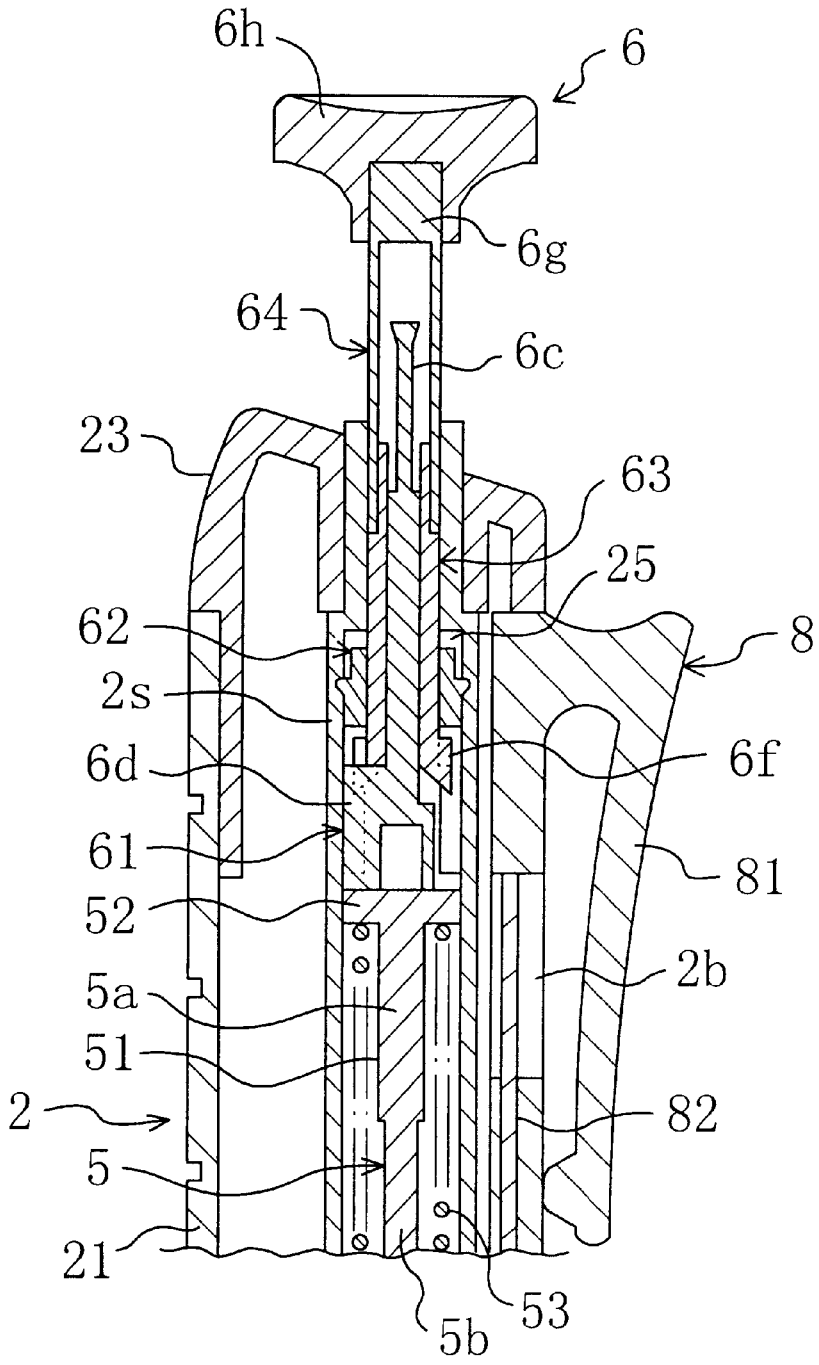
FIG. 6 is an enlarged vertical cross section showing the top side portion of the pipette.
Figure 7:
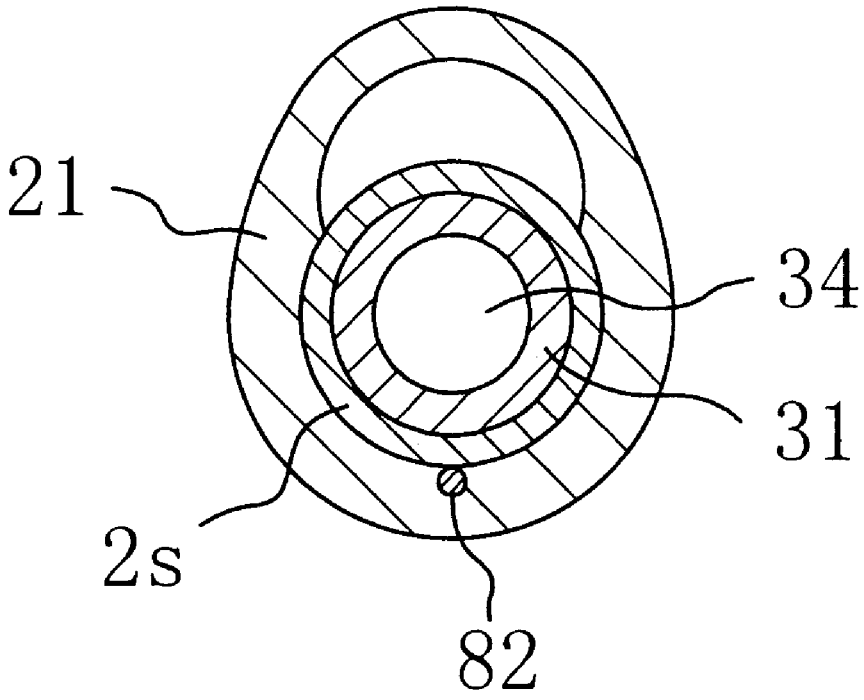
FIG. 7 is a cross section taken on line VII—VII of FIG. 4.
Figure 10:
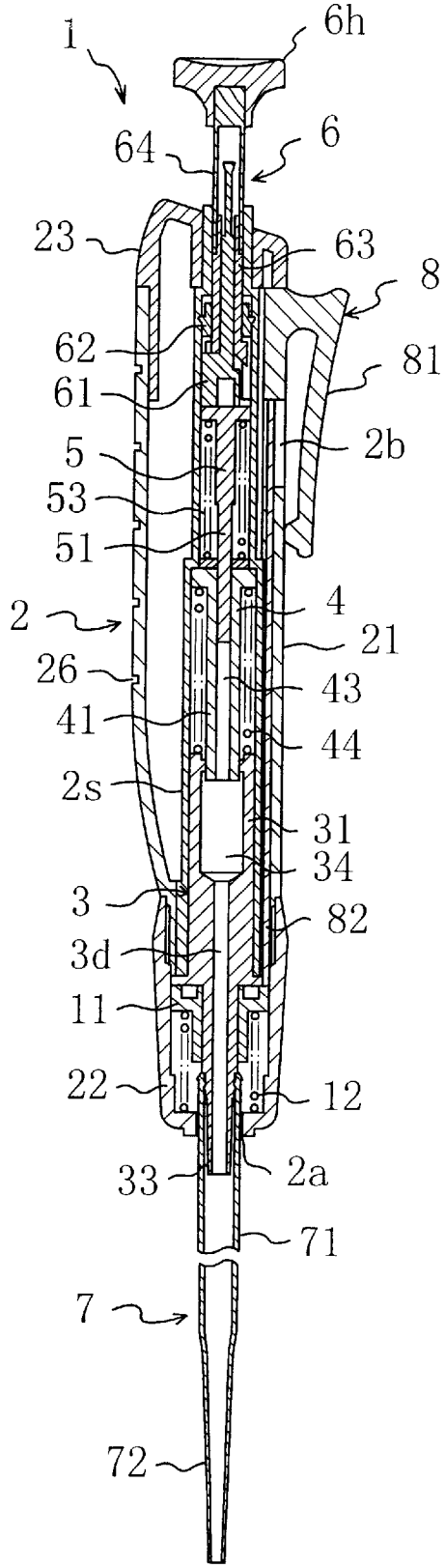
FIG. 10 is a vertical cross section of the pipette to which the tip is attached.
Figure 11:
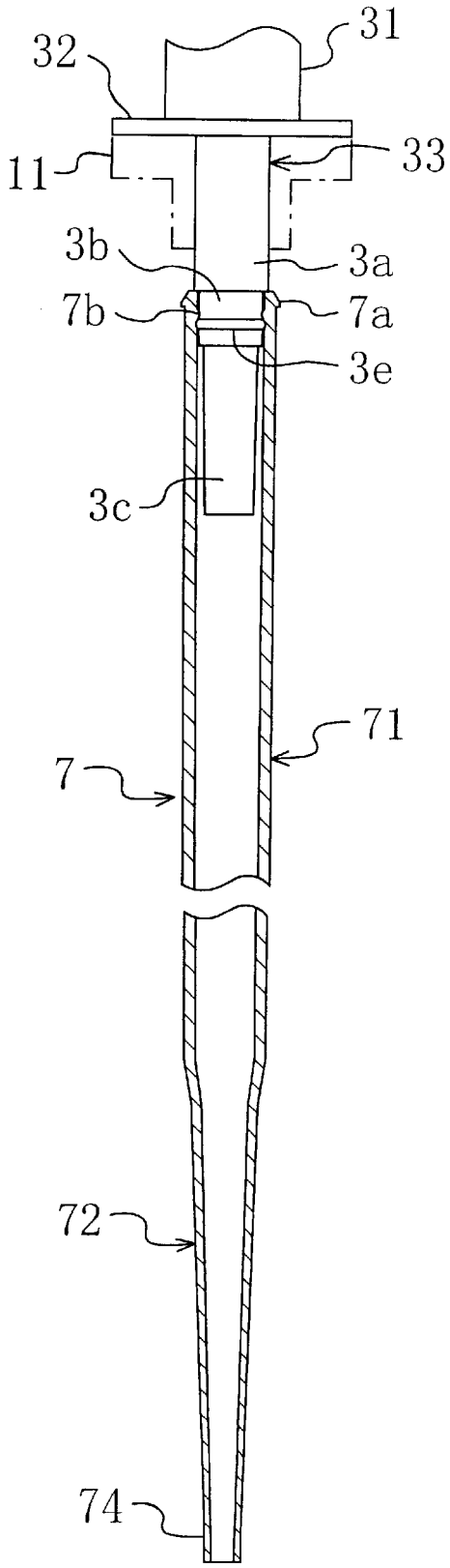
FIG. 11 is a vertical cross section showing a state that the tip is attached to the nozzle.
Figure 12:
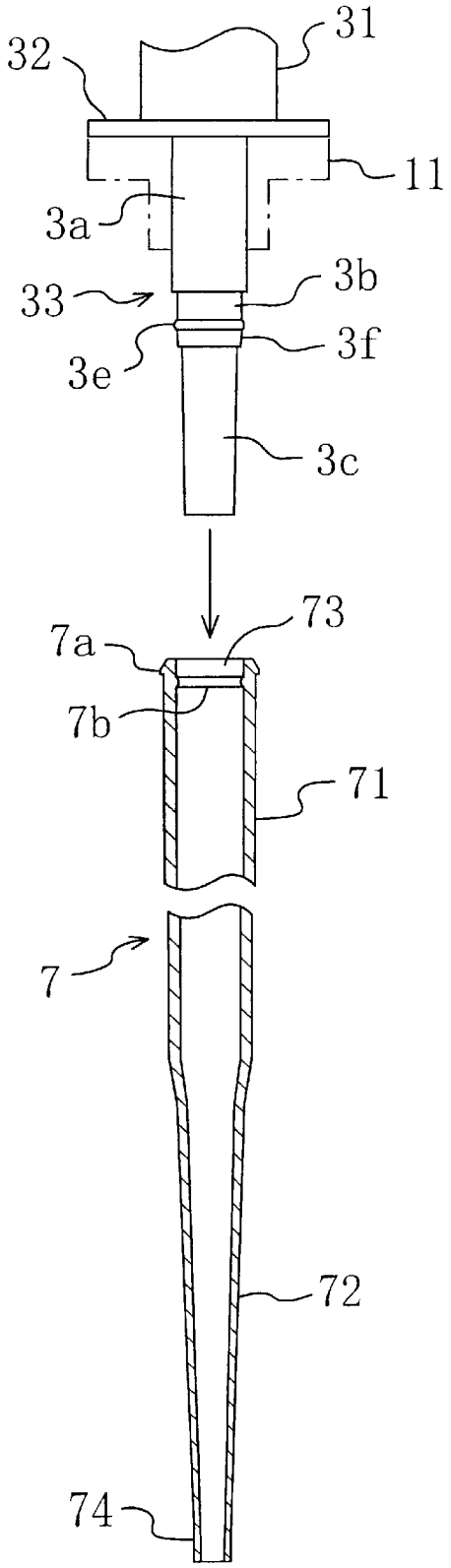
FIG. 12 is a vertical cross section showing a state that the tip is released from the nozzle.

As shown in FIG. 5, the nozzle 33 of the cylinder 3 is formed continuously with the cylinder body 31 so as to protrude from the flange 32 toward the tip end of the casing 2, and passes through an opening 2*a* of the end cap 22. In the nozzle 33, as shown in FIGS. 10 through 12, a root portion 3*a,* an intermediate portion 3*b* and a distal end portion 3*c* are continuously formed. The root portion 3*a* extends from the flange 32 and has a large diameter. The intermediate portion 3*b* is formed in a smaller diameter than the root portion 3*a* and constitutes a tip attachment part. The distal end portion 3*c* is formed in a smaller diameter than the intermediate portion 3*b*. Further, the nozzle 33 is internally provided with a suction passage 3*d* in communication with the first suction chamber 34, and the suction passage 3*d* is open on the distal end surface of the nozzle 33.

Figure 13:
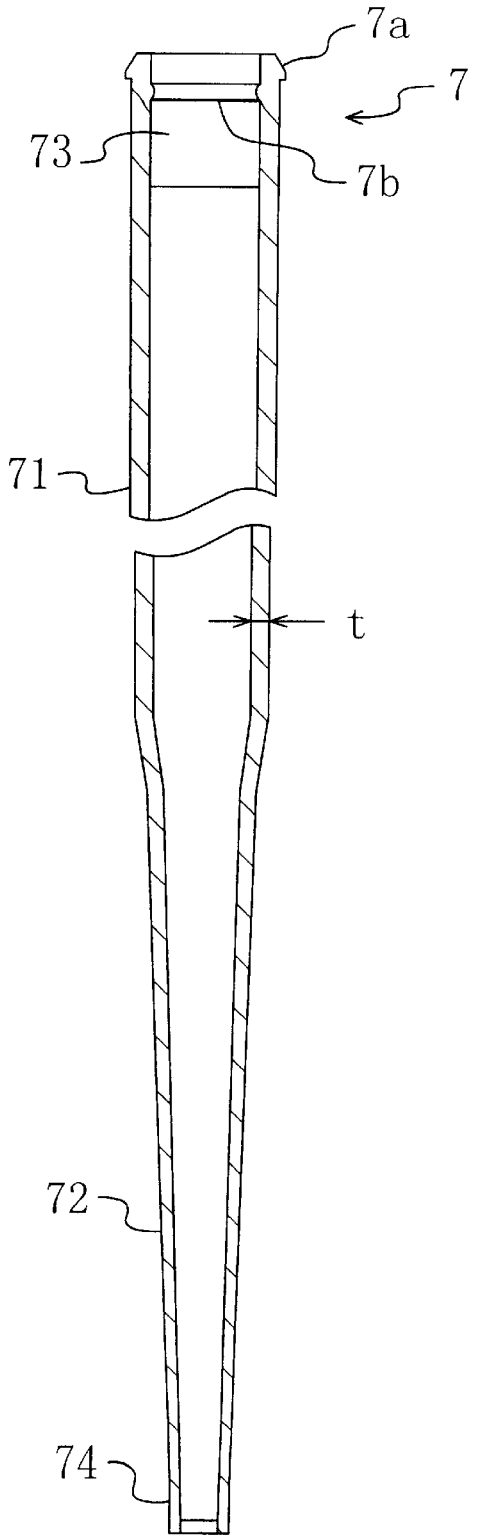
FIG. 13 is a vertical cross section of the tip.
Figure 14:
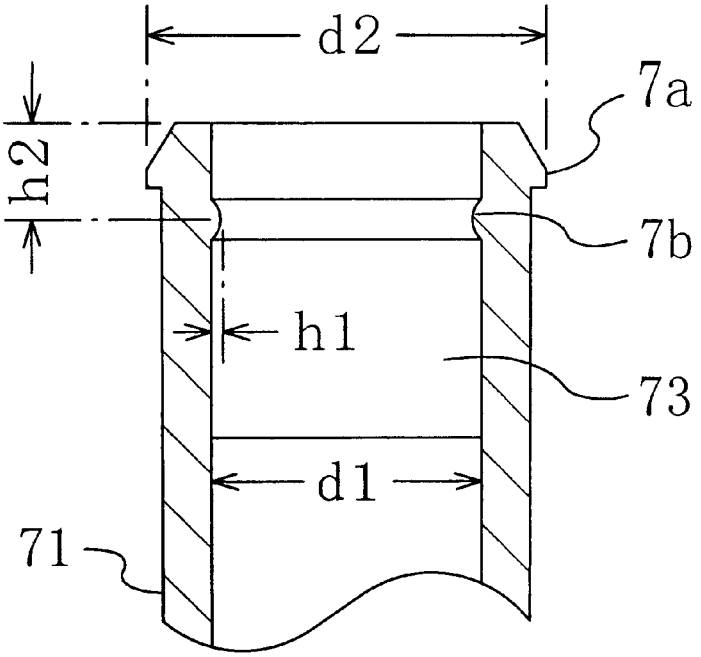
FIG. 14 is an enlarged vertical cross section of a root portion of the tip.
Figure 15:
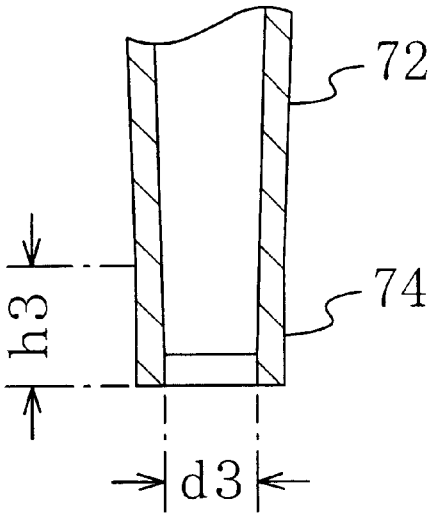
FIG. 15 is an enlarged vertical cross section of a distal end portion of the tip.

As shown in FIGS. 13 through 15, the nozzle 33 is provided with a tip 7 freely attachable thereto and detachable therefrom. The tip 7 is formed into a small-diameter cylinder, and has a tip body formed of a main body portion 71 and a tapered portion 72. The main body portion 71 is formed into an approximately straight cylinder. The tapered portion 72 is formed continuously with the extension part 71 and is tapered to diminish its diameter toward the distal end of the tip 7.

The tip 7 is formed of a translucent material with a thickness t of, for example, 0.4 through 0.7 mm. The inner diameter d1 of the main body portion 71 is for example 4.40 mm. As a feature of the present invention, an end portion of the tip 7 proximate to the opening of the main body portion 71 is formed into a receiving part 73 for receiving the nozzle 33. The receiving part 73 constitutes a nozzle-fitting part in which a thick portion 7*a* and an annular projection 7*b* are formed.

The thick portion 7*a* is formed in an approximately truncated cone, and has a maximum outer diameter d2 of 6.5 mm for example. Namely, the thick portion 7*a* is formed larger in outer diameter than the root portion 3*a* of the nozzle 33.

The annular projection 7*b* is formed along the inner periphery of the main body portion 71, and has a half-round cross section the curvature radius R of which is 0.5 mm thereby constituting an annular part. Further, the annular projection 7*b* is formed such that its extended amount h1 is for example 0.05 through 0.2 mm and its length h2 from the center of the annular projection 7*b* to the opening end of the main body portion 71 is 1.50 mm.

The inner diameter d3 at the distal end of the tapered portion 72 is for example 1.5 mm. A sub-portion of the tapered portion 72 along a length h3 of 2.0 mm from the distal end thereof is formed into a straight end section 74.

As shown in FIG. 5, a cylindrical releasing member 11 is axially movably attached around the root portion 3*a* of the nozzle 33. Between the releasing member 11 and the end cap 22, a compression spring 12 as a resilient member is interposed. The releasing member 11 is pushed in a direction away from the distal end of the nozzle 33 by the compression spring 12 and is pressed against the flange 32 of the cylinder 3. The inner diameter of the releasing member 11 is smaller than the outer diameter of the thick portion 7*a* of the tip 7. Therefore, the releasing member 11 is constructed such that when it is moved toward the distal end of the nozzle 33 by a detaching means 8, it abuts against the thick portion 7*a* of the tip 7 and acts to detach the tip 7 from the nozzle 33.

Figure 16:
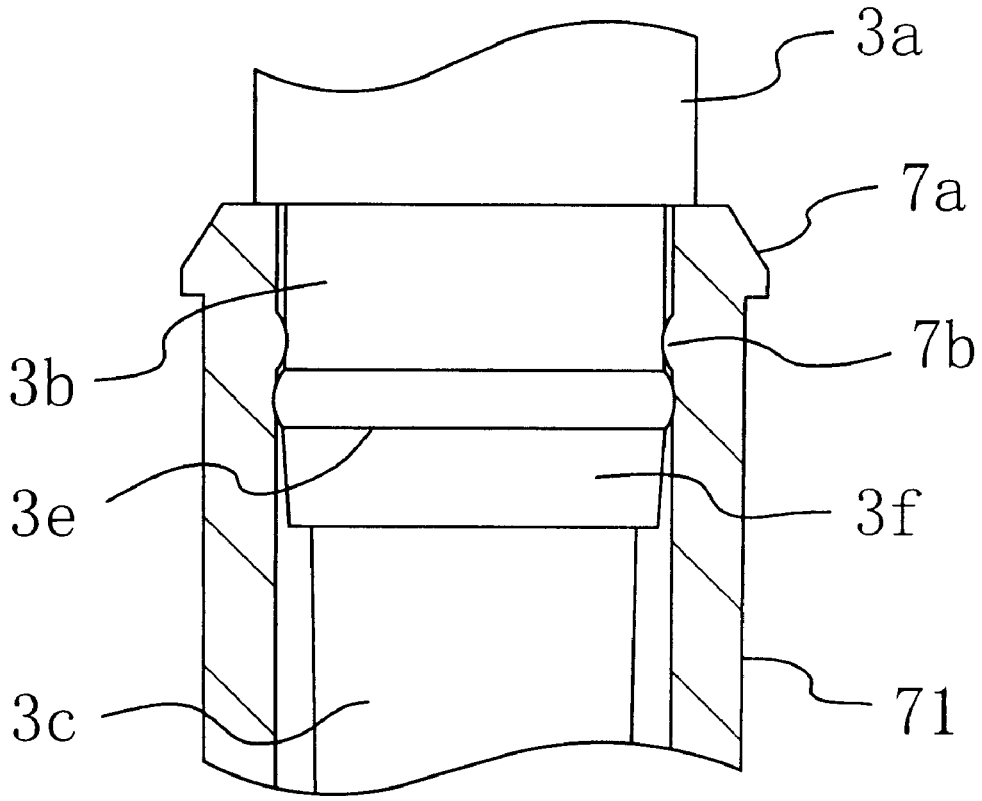
FIG. 16 is an enlarged vertical cross section showing a part where the tip is attached to the nozzle.

As shown in FIG. 16, an annular projection 3*e* is formed in the intermediate portion 3*b* of the nozzle 33. The annular projection 3*e* is formed, like the annular projection 7*b* of the tip 7, such that the curvature radius of the cross section thereof is for example 0.5 mm and the extended amount thereof is for example 0.05 through 0.2 mm, thereby constituting an annular part. In addition, the annular projection 3*e* is formed such that the length from the center thereof to the shoulder of the root portion 3*a* is for example 2.00 mm.

With this construction, as shown in FIG. 16, when the nozzle 33 is inserted into the receiving part 73 of the tip 7, the annular projection 7*b* of the tip 7 snaps over the annular projection 3*e* of the nozzle 33. Further, both the annular projections 7*b* and 3*e* are positioned such that an abutment sound indicating a feeling of fitting between the tip 7 and the nozzle 33 is produced between the opening end surface of the tip 7 and the shoulder of the nozzle 33 when the fitting therebetween is completed. In addition, at the time, both the annular projections 7*b* and 3*e* come into close contact with each other, which provides a seal between the tip 7 and the nozzle 33.

In the intermediate portion 3*b* of the nozzle 33, a sub-portion closer to the distal end than the annular projection 3*e* is formed into a tapered section 3*f*.

The detaching means 8 is composed of a clip 81 and a detaching pin 82. The clip 81 is provided for free movement in a mounting groove 2*b* axially formed on the top part of the body part 21 of the casing 2. The clip 81 is inclined on the body part 21 side to diminish its extended amount toward its distal end, thereby providing ease grip.

The detaching pin 82 is inserted into the body part 21 of the casing 2 so as to pass through the body part 21. The detaching means 8 is so constructed that when the clip 81 is pushed down from the position of FIG. 4, the detaching pin 82 moves downward and passes through the flange 32 of the cylinder 3 to push the releasing member 11 downward and the pushed releasing member 11 detaches the tip 7 from the nozzle 33.

Sampling

Next, a description will be given to the sampling of a liquid sample with the use of the above-mentioned pipette 1.

The pipette 1 of FIG. 10 is in a state before sucking a liquid sample. In this state, the releasing member 11 comes into contact with the flange 32 of the cylinder 3, the first piston 4 extends from the cylinder body 31, and the second piston 5 extends from the first piston 4. Both the pistons 4, 5 are in their extreme extended positions. Accordingly, the first and second suction chambers 34 and 43 each have a maximum capacity.

In the above state, the tip 7 is fitted on the nozzle 33 so as to be connected to the cylinder 3. When the nozzle 33 is inserted into the tip 7, the tip-side annular projection 7*b* slides over the nozzle-side annular projection 3*e* and at the same time an abutment sound is produced between the opening end surface of the tip 7 and the shoulder of the nozzle 33, thereby completing the insertion of the nozzle 33 into the tip 7. The analyzer can recognize the completion of insertion based on this abutment sound. At the time, the tip-side annular projection 7*e* and the nozzle-side annular projection 3*e* are brought into close contact with each other, which provides a seal between the tip 7 and the nozzle 33. FIG. 16 shows the state where the insertion of the nozzle 33 into the tip 7 is completed.

Thereafter, the body part 21 of the casing 2 is griped with one hand, and the push part 6*h* of the operating lever 6 is then pushed with a thumb of the hand to move the knocking cover 64 downward. The downward movement of the knocking cover 64 moves the knocking member 63 downward so that the slide parts 6*d*, 6*d*, . . . in contact with the cams 6*f*, 6*f*, . . . are pushed down. Thus, the rotor 61 is moved downward.

When the rotor 61 moves downward, the second piton 5 is pushed down. At this time, since the second spring 53 is set to have less resiliency than the first spring 44, only the second spring 53 is first compressed so that the piston body 51 of the second piston 5 is inserted deep into the second suction chamber 43. As a result, the second suction chamber 43 is reduced in capacity.

When the knocking cover 64 is further pushed down, the slide parts 6*d*, 6*d*, . . . of the rotor 61 are moved out of the slide grooves 6*a*, 6*a*, . . . of the guide member 62. The slide parts 6*d*, 6*d*, . . . moved out of the slide grooves 6*a*, 6*a*, . . . slide on the cam surfaces of the cams 6*f*, 6*f*, . . . so that the rotor 61 slightly rotates. As a result, the top surfaces of the slide parts 6*d*, 6*d*, . . . are brought into contact with the bottom surfaces of the strips 6*b*, 6*b*, . . . of the guide member 62. At the time of rotation of the rotor 61, the slide parts 6*d*, 6*d*, . . . abut against the adjacent cams 6*f*, 6*f*, . . . , respectively, to generate knocking sounds.

Figure 17:
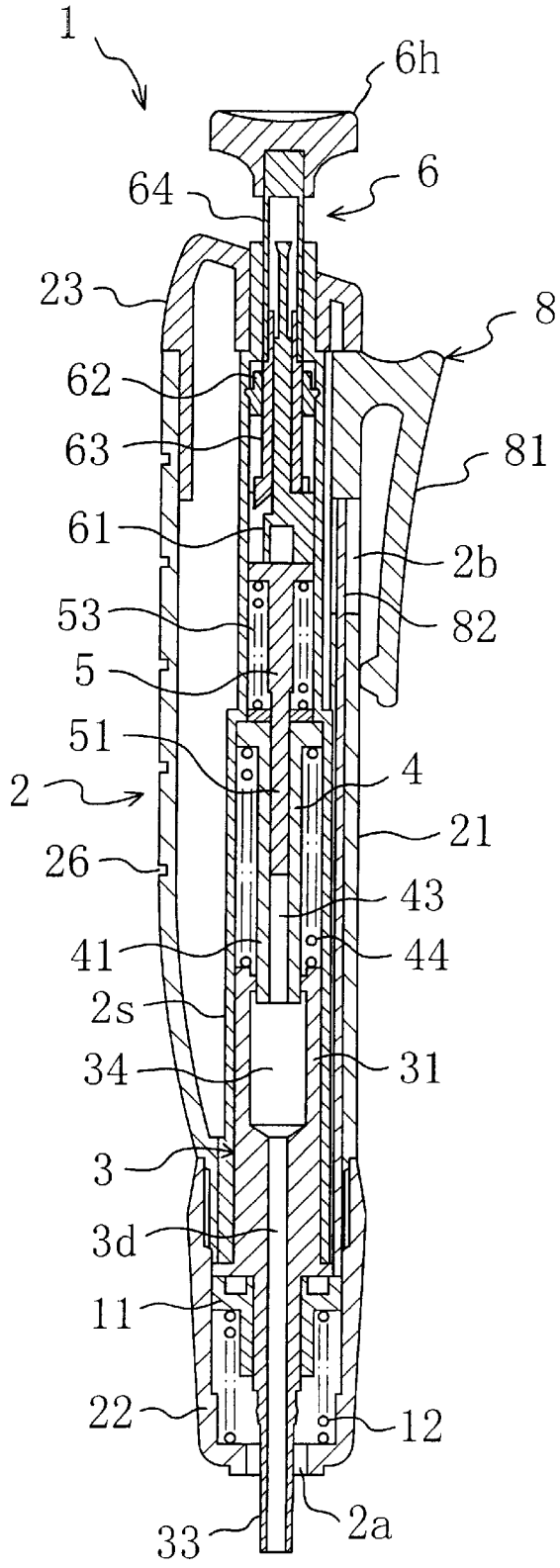
FIG. 17 is a vertical cross section showing the pipette under operation in a small suction position.

The position of the rotor 61 after rotation is shown in FIG. 17. In this state, the end surface of the large-diameter part 5*a* of the piston body 51 of the second piston 5 comes close to the flange 42 of the first piston 4 with the retaining member 15 sandwiched therebetween. At this time, the small-diameter part 5*b* of the second piston 5 is made deepest inserted into the second suction chamber 43, so that the second piston 5 is set in the small suction position for sampling a small amount of liquid. In this specific embodiment, when the above-mentioned knocking sounds occur, the second piston 5 comes to the small suction position. The capacity in the small suction position is set at a sampling amount of, for example, 15 μl.

When the knocking cover 64 is still further pushed down, the shaft part 6*e* of the knocking member 63 comes into contact with the slide parts 6*d*, 6*d*, . . . and in this state the rotor 61 is further moved downward. Thus, the large-diameter part 5*a* of the second piston 5 meets the first piston 4 and pushes it downward to compress the first spring 44, so that the piston body 41 of the first piston 4 is inserted deep into the first suction chamber 34. As a result, the capacity of the first suction chamber 34 is reduced.

Figure 18:
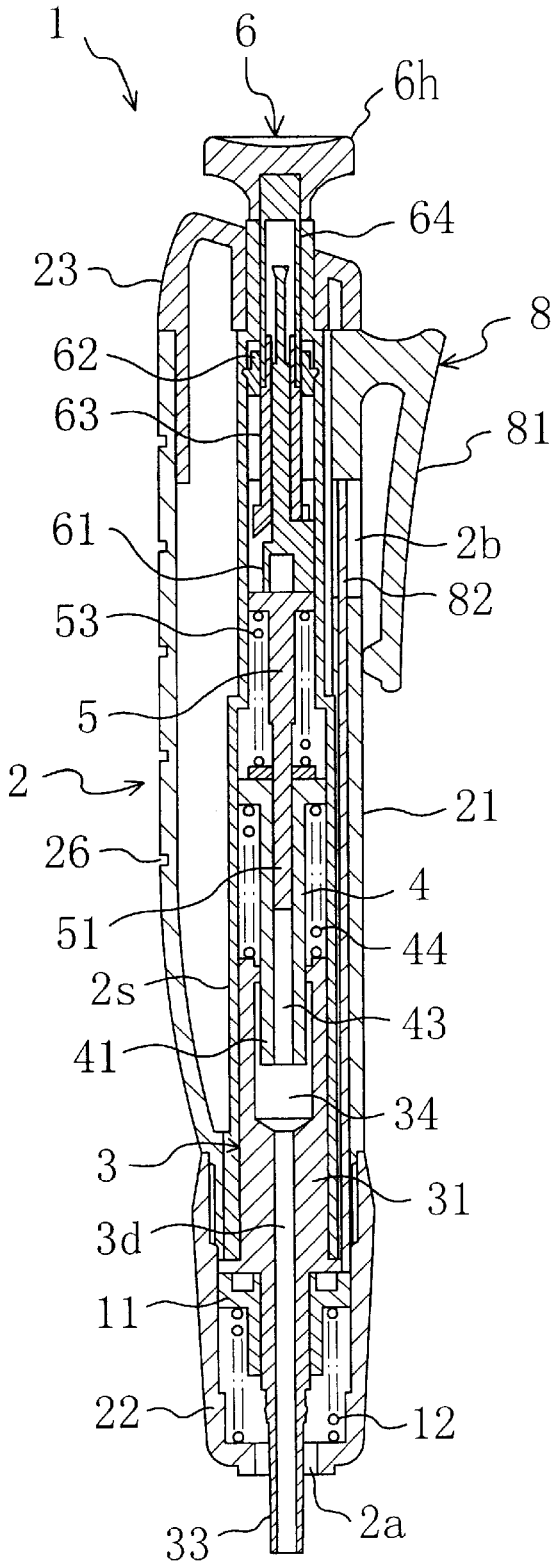
FIG. 18 is a vertical cross section showing the pipette under operation in a large suction position.

When the knocking cover 64 is pushed down to the deepest position, the pipette 1 comes into the state shown in FIG. 18, i.e., the state that the piston body 41 of the first piston 4 is made deepest inserted into the first suction chamber 34. In detail, the first piston 4 is deepest inserted into the first suction chamber 34 in the state that, the second piston 5 is deepest inserted into the second suction chamber 43, so that the first piston 4 is set in the large suction position for sampling a large amount of liquid. The capacity in the large suction position is set at a sampling amount of, for example, 500 μl.

When the push of the knocking cover 64 is eliminated, the first and second pistons 4 and 5 extend by the resiliency of the first and second springs 44 and 53 to come back into the initial state of FIG. 10.

Detailed description will be made next about a selection between the large amount sampling and the small amount sampling in the above-mentioned pipette 1.

For example, when urinalysis is carried out in a physical checkup or the like, picked urine is first centrifuged, the supernatant fluid is removed and a sample including 200 μl of liquid is prepared. For this purpose, the pipette 1 is first put into the large suction position where the knocking cover 64 is deepest pushed down (See FIG. 18). In this state, the tip 7 is put in a liquid in a vessel for sample picking, the knocking cover 64 is then moved backward until the amount of liquid in the vessel reaches 200 μl, and the supernatant fluid is removed.

Thereafter, 200 μl of liquid and the residue in the vessel are mixed. For this purpose, the knocking cover 64 is adequately pushed down to supply air into the sample and the sample is stirred. Then, from the mixture, 15 μl of liquid sample for an urine precipitation test is picked up. For this purpose, the pipette 1 is put into the small suction position where the knocking cover 64 is slightly pushed down (See FIG. 17). In this state, the tip 7 is put in the liquid sample in the vessel for sample picking, and the knocking cover 64 is then moved backward to pick up the liquid sample.

For detachment of the tip 7, the clip 81 is pushed down to move the detaching pin 82 downward so that the releasing member 11 moves downward. When the releasing member 11 moves downward, the bottom end thereof abuts against the thick portion 7*a* of the tip 7 to detach the tip 7 from the nozzle 33, though the case is not shown.

Effects of the Invention

According to the present embodiment as mentioned so far, since the annular projection 7*b* provided along the inner periphery of the tip 7 forms a seal between the tip 7 and the nozzle 33, the attachment of the tip 7 can be made with reliability. As a result, a large number of samples can be analyzed promptly and reliably.

In particular, since the annular projections 7*b* and 3*e*, provided in the tip 7 and the nozzle 33, respectively, form a seal therebetween and a sound of abutment therebetween is produced at the position where the insertion of the nozzle 33 into the tip 7 is completed, the attachment of the tip 7 can be correctly recognized.

Further, though the tip 7 is required to be detached for each sampling and replaced with new one, the pipette of the present embodiment enables prompt analyses of a large number of samples in such a case.

Furthermore, since the annular projection 7*b* of the tip 7 comes into close contact with the annular projection 3*e* of the nozzle 33 by snapping over the annular projection 3*e* of the nozzle 33, a seal can reliably be provided between the tip 7 and the nozzle 33. Accordingly, sucking liquid can be made correctly, which provides an improved analyzing accuracy.

Moreover, the release of the tip 7 is implemented by simply snapping out the annular projection 7*b* of the tip 7 over the annular projection 3*e* of the nozzle 3, and therefore a contact area between the tip 7 and the nozzle 33 is small. Accordingly, the release of the tip 7 can be made readily. As a result, the tip 7 can be released with one hand, which provides improved workability.

In addition, the tip 7 can be detached through the operation of the clip 81 alone. As a result, samples are avoided from touch with hand, which enables the analysis or the like to be executed in a prompt and considerably sanitary manner.

Further, since the first and second pistons 4 and 5 are two-deep inserted into the cylinder 3 and are reciprocated, selection can be made between the large amount sampling and the small amount sampling. As a result, the pipette of the present embodiment provides an extended range of applications as compared with the conventional pipette whose sampling amount is limited to a fixed amount. In particular, when a large number of samples are analyzed, a necessary amount of liquid can readily be sampled, which achieves prompt analyzing.

Furthermore, since the pipette of the present embodiment can simplify the structure and reduce the number of parts as compared with the conventional pipette of the capacity-variable type whose sampling amount is arbitrarily set, this reduces the manufacturing cost.

Moreover, selection between the large amount sampling and the small amount sampling can be made with one hand, i.e., at the push of the push part 6*h* with a thumb. As a result, operation can be simplified thereby speeding up the execution of various kinds of analyses.

Other Embodiments of the Invention

In the above embodiment, the tip-side annular projection 7*b* and the nozzle-side annular projection 3*e* are positioned such that an abutment sound is produced between the end surface of the tip 7 and the shoulder of the nozzle 33. However, the fitting structure between the tip and the nozzle in the present invention may not necessarily produce such an abutment sound. In other words, in the present invention, it is essential only that a feeling of fitting between the tip and the nozzle is provided. For example, only a shock due to fitting may be provided.

In the above embodiment, the first and second pistons 4 and 5 are provided. In the present invention, however, two pistons may not necessarily be provided and the sampling amount may be fixed.

The shape of the annular projections 3*e*, 7*b* is not limited to a half-round cross section as employed in the above embodiment. Cams in an elliptical shape or other shapes may be employed for an annular part of the present invention.

In particular, the annular projections 3*e* and 7*b* may have different shapes from each other. Also, each of the annular projections 3*e* and 7*b* provided may be two or more in number.

The shape of the thick portion 7*b* of the tip 7 is not limited to a truncated cone, and the thick portion 7*b* may have a ring shape or any other shape. In essence, the thick portion 7*b* may have a shape to allow abutment against the releasing member 11.

The first spring 44, the second spring 53 and the compression spring 12 are not limited to coil springs shown in the above embodiment. For those springs, various kinds of resilient members such as a leaf spring and a piece of rubber are applicable.

What is claimed is:

1. A tip for a pipette freely attachable to and detachable from a nozzle of the pipette, the tip comprising:

a tapered tip body having an elongated cylindrical form;

a nozzle-fitting part formed in a root portion of the tip body;

an annular part formed along an inner periphery of the nozzle-fitting part to extend inwardly therefrom for close contact with an outer periphery of the nozzle; and a thick portion formed around an outer periphery of an end portion of the nozzle-fitting part to extend outwardly therefrom for abutment against a tip releasing member for detaching the tip body from the nozzle of the pipette.

2. The tip for a pipette of claim 1, wherein the nozzle of the pipette includes a root portion, a tip attachment part formed smaller in diameter than the root portion and continuously therefrom through a shoulder, and an annular part formed around an outer periphery of the tip attachment part to extend outwardly therefrom, the annular part of the tip body is formed to be closely contactable with the annular part of the nozzle and to reach a position where a feeling of fitting between the tip body and the nozzle is provided through the abutment of an end surface of the nozzle-fitting part of the tip body against the shoulder of the nozzle at the completion of fitting of the tip body onto the nozzle, and the thick portion of the nozzle fitting part of the tip body is formed larger in diameter than the root portion of the nozzle to be located outside the root portion of the nozzle for abutment against the tip releasing member freely movable in an axial direction of the nozzle.

3. The tip for a pipette of claim 2, wherein both the annular parts of the nozzle and the tip body are each formed into a projection of half-round cross section, and the annular part of the tip body is formed to complete the fitting of the tip body onto the nozzle by snapping over the annular part of the nozzle.

4. A pipette comprising:

a cylindrical casing;

a cylinder provided in the casing;

a suction chamber formed in the cylinder;

a nozzle which is continuously formed at an outward end of the cylinder to extend to the outside of the casing and has a suction passage in communication with the suction chamber;

at least one piston which is provided in the casing and is reciprocatably inserted into the suction chamber to suck and discharge liquid; and a tip freely attachable to and detachable from the nozzle, wherein the nozzle includes a root portion, a tip attachment part formed smaller in diameter than the root portion and continuously from the root portion through a shoulder, an annular part formed around an outer periphery of the tip attachment part to extend outwardly therefrom, and a tip releasing member provided outside of the root portion and freely movable in an axial direction of the nozzle, and the tip includes a tapered tip body having an elongated cylindrical form, a nozzle-fitting part formed in a root portion of the tip body, an annular part which is formed along an inner periphery of the nozzle-fitting part to extend inwardly therefrom and closely contacts with the annular part of the nozzle, and a thick portion formed around an outer periphery of an end portion of the nozzle-fitting part to extend outwardly therefrom and having a larger diameter than that of the root portion of the nozzle to be abuttable against the tip releasing member.

5. A pipette comprising:

a cylindrical casing;

a cylinder formed at an inner tip end of the casing;

a first suction chamber which is formed in the cylinder and is open on an inward end surface of the cylinder;

a nozzle which is formed at an outward end of the cylinder to extend to the outside of the casing and has a suction passage in communication with the first suction chamber;

a first piston reciprocatably inserted into the first suction chamber;

a second suction chamber which is formed in the first piston and is open on both end surfaces of the first piston;

a second piston reciprocatably inserted into the second suction chamber, the second piston including a small-diameter part insertable into the second suction chamber and a large-diameter part engageable with the first piston to push the first piston;

a first resilient member which pushes the first piston in a direction of protruding from the cylinder;

a second resilient member which pushes the second piston in a direction of protruding from the first piston, the second resilient member having less resiliency than the first resilient member;

an operating lever which is provided in the casing, comes into contact at an inward end thereof with a top surface of the second piston, and operates the first and second pistons to switch between a small suction position where the second piston is extremely retracted in the first piston and a large suction position where the first and second pistons are extremely retracted in the cylinder and the first piston, respectively; and a tip freely attachable to and detachable from the nozzle, wherein the nozzle includes a root portion, a tip attachment part formed smaller in diameter than the root portion and continuously from the root portion through a shoulder, an annular part formed around an outer periphery of the tip attachment part to extend outwardly therefrom, and a tip releasing member provided outside of the root portion and freely movable in an axial direction of the nozzle, and the tip includes a tapered tip body having an elongated cylindrical form; a nozzle-fitting part formed in a root portion of the tip body; an annular part which is formed along an inner periphery of the nozzle-fitting part to extend inwardly therefrom and closely contacts with the annular part of the nozzle; and a thick portion formed around an outer periphery of an end portion of the nozzle-fitting part to extend outwardly therefrom and having a larger diameter than that of the root portion of the nozzle to be abuttable against the tip releasing member.

6. A pipette comprising:

a cylindrical casing;

a cylinder formed at an inner tip end of the cylindrical casing;

a first suction chamber which is formed in the cylinder and is open on an inward end surface of the cylinder;

a nozzle which is formed at an outward end of the cylinder to extend to the outside of the casing and has a suction passage in communication with the first suction chamber;

a first piston which is reciprocatably inserted into the first suction chamber;

a second suction chamber which is formed in the first piston and is open on both end surfaces of the first piston;

a second piston which is reciprocatably inserted into the second suction chamber;

a first resilient member which pushes the first piston in a direction of protruding from the cylinder, the first resilient member surrounding the second suction chamber;

a second resilient member which pushes the second piston in a direction of protruding from the first piston, the second resilient member having less resiliency than the first resilient member;

an operating lever which is provided in the casing, comes into contact at an inward end surface thereof with a top surface of the second piston, and operates the first and second pistons to switch between a small suction position where the second piston is extremely retracted in the first piston and a large suction position where the first and second pistons are extremely retracted in the cylinder and the first piston, respectively; and a tip freely attachable to and detachable from the nozzle, wherein the nozzle includes a root portion, a tip attachment part formed smaller in diameter than the root portion and continuously from the root portion through a shoulder, an annular part formed around an outer periphery of the tip attachment part to extend outwardly therefrom, and a tip releasing member provided outside of the root portion and freely removable in an axial direction of the nozzle, and the tip includes a tapered tip body having an elongated cylindrical form, a nozzle-fitting part formed in a root portion of the tip body, an annular part which is formed along an inner periphery of the nozzle-fitting part to extend inwardly therefrom and closely contacts with the annular part of the nozzle, and a thick portion formed around an outer periphery of an end portion of the nozzle-fitting part to extend outwardly therefrom and having a larger diameter than that of the root portion of the nozzle to be abuttable against the tip releasing member.

7. The pipette of any one of claims 4 through 6, wherein both the annular parts of the tip and the nozzle are provided to reach a position where a feeling of fitting between the tip and the nozzle is provided between a root end surface of the nozzle-fitting part of the tip and the shoulder of the nozzle at the completion of fitting of the tip onto the nozzle.

8. The pipette of any one of claims 4 through 6, wherein both the annular parts of the nozzle and the tip are each formed into a projection of half-round cross section, and the annular part of the tip is formed to complete the fitting of the tip onto the nozzle by snapping over the annular part of the nozzle.

9. The pipette of any one of claims 4 through 6, wherein a resilient member for pushing the tip releasing member in a direction away from a distal end of the nozzle is interposed between a tip end of the casing and the tip releasing member, and detaching means is provided for moving the tip releasing member to release the tip from the nozzle.

* * * * *

UNITED STATES PATENT AND TRADEMARK OFFICE

CERTIFICATE OF CORRECTION

PATENT NO. : 6,499,363 B1
DATED : December 31, 2002
INVENTOR(S) : Ichiro Morimoto et al.

It is certified that error appears in the above-identified patent and that said Letters Patent is hereby corrected as shown below:

Title page,
Item [73], Assignee, add -- Itochu Corporation, Osaka (JP) --.

Signed and Sealed this

Twenty-eighth Day of October, 2003

JAMES E. ROGAN
*Director of the United States Patent and Trademark Office*